US009701117B2

(12) United States Patent
Nakao et al.

(10) Patent No.: US 9,701,117 B2
(45) Date of Patent: Jul. 11, 2017

(54) LIQUID-JET HEAD AND LIQUID-JET APPARATUS

(71) Applicant: SEIKO EPSON CORPORATION, Tokyo (JP)

(72) Inventors: Hajime Nakao, Azumino (JP); Takaaki Koizumi, Tajimi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 156 days.

(21) Appl. No.: 14/226,602

(22) Filed: Mar. 26, 2014

(65) Prior Publication Data

US 2014/0292946 A1 Oct. 2, 2014

(30) Foreign Application Priority Data

Mar. 28, 2013 (JP) ..... 2013-070483

(51) Int. Cl.
*B41J 2/14* (2006.01)

(52) U.S. Cl.
CPC ..... *B41J 2/14233* (2013.01); *B41J 2202/11* (2013.01)

(58) Field of Classification Search
CPC ..... B41J 2/14233; B41J 2/1404; B41J 2/161; B41J 2/14201; B41J 2202/11
USPC ..... 347/65, 68, 70
See application file for complete search history.

(56) References Cited

U.S. PATENT DOCUMENTS 4,424,520 A * 1/1984 Matsuda et al. ..... 347/11
4,882,595 A * 11/1989 Trueba ..... B41J 2/1404 347/85
5,754,205 A * 5/1998 Miyata et al. ..... 347/70
6,137,511 A * 10/2000 Furuhata et al. ..... 347/70
6,378,996 B1 * 4/2002 Shimada et al. ..... 347/70
6,416,680 B1 * 7/2002 Mitsuzawa et al. ..... 216/27
7,654,652 B2 * 2/2010 Tobita et al. ..... 347/71
7,867,407 B2 * 1/2011 Kitahara ..... 216/27
2002/0008740 A1 * 1/2002 Fujii ..... 347/65
2002/0101137 A1 * 8/2002 Tanikawa et al. ..... 310/363
2003/0197760 A1 * 10/2003 Tsuchii et al. ..... 347/56
2003/0206218 A1 * 11/2003 Miyata et al. ..... 347/70
2005/0104941 A1 * 5/2005 Tanaka ..... 347/70

(Continued)

FOREIGN PATENT DOCUMENTS

JP 3422364 B2 6/2003
JP 2005-053080 A 3/2005

*Primary Examiner* — Matthew Luu
*Assistant Examiner* — Patrick King
(74) *Attorney, Agent, or Firm* — Maschoff Brennan

(57) ABSTRACT

A liquid-jet head includes: a passage member including a plurality of individual passages and a manifold communicating commonly with the individual passages, the individual passages each having a pressure generating chamber communicating with a nozzle orifice that ejects liquid, the pressure generating chambers being formed on one surface side of the passage member on an opposite side from the nozzle orifices, the individual passages and the manifold communicating with each other through communicating paths, and each adjacent two of the individual passages communicating with each other through the corresponding communicating path; and reinforcement walls each provided between the communicating paths in a parallel direction of the individual passages, the reinforcement walls defining the communicating paths.

5 Claims, 9 Drawing Sheets

(56) References Cited

U.S. PATENT DOCUMENTS

| | | | | |
|---|---|---|---|---|
| 2007/0046737 | A1* | 3/2007 | Sugahara | 347/68 |
| 2007/0165067 | A1* | 7/2007 | Imanaka et al. | 347/40 |
| 2007/0206065 | A1* | 9/2007 | Tomizawa | B41J 2/1404 347/65 |
| 2008/0018204 | A1* | 1/2008 | Sugahara | H01L 41/0973 310/330 |
| 2008/0068425 | A1* | 3/2008 | Nathan | B41J 2/14233 347/68 |
| 2008/0117262 | A1* | 5/2008 | Mori | B41J 2/14274 347/65 |
| 2010/0328409 | A1* | 12/2010 | Matsufuji | B41J 2/14233 347/93 |
| 2012/0069101 | A1* | 3/2012 | Kato | B41J 2/14233 347/70 |
| 2012/0206540 | A1* | 8/2012 | Kato et al. | 347/50 |

* cited by examiner

LIQUID-JET HEAD AND LIQUID-JET APPARATUS

The entire disclosure of Japanese Patent Application No. 2013-070483 filed Mar. 28, 2013 is expressly incorporated by reference herein.

BACKGROUND

1. Technical Field

The present relates to a liquid-jet head and a liquid-jet apparatus that jet a liquid from nozzle orifices, and particularly relates to an inkjet recording head and an inkjet recording apparatus that eject ink as the liquid.

2. Related Art

As a representative example of a liquid-jet head, an inkjet recording head that eject ink droplets as a liquid from nozzle orifices is known, for example. Specifically, such an inkjet recording head is provided with pressure generating chambers communicating with the respective nozzle orifices, and ejects ink droplets from the nozzle orifices by generating pressure change in the pressure generating chambers by use of pressure generators such as piezoelectric actuators.

In addition, such an inkjet recording head is provided with a plurality of pressure generating chambers and a manifold that is provided commonly for the plurality of pressure generating chambers. The manifold and each of the pressure generating chambers are connected by an ink supply path, a communicating path, and the like which generate passage resistance, so that the pressure changes in the pressure generating chambers are directed toward the nozzle orifices.

In this connection, there is a proposed ink supply path that is caused to generate passage resistance by making a depth thereof smaller than that of the pressure generating chamber in a lamination direction of a passage forming substrate and a joint plate, which is another member joined to the passage forming substrate (see for example Japanese Patent No. 3422364).

Alternatively, there is another proposed ink supply path that is caused to generate passage resistance by making a width thereof smaller than that of the pressure generating chamber (in a parallel direction of the pressure generating chambers) (see for example JP-A-2005-53080).

However, if an external pressure is applied to the passage forming substrate, such application of the external pressure may lead to destruction of a compartment wall which defines the ink supply path or the communicating path because the compartment wall has a low rigidity, and may also lead to a problem that destruction such as cracking occurs in a vibration plate due to flexural deformation of the vibration plate, the piezoelectric actuator, or the like. Note that such an external pressure, which is applied to the passage forming substrate, is generated, for example, when a joint plate such as a reservoir forming plate (a manifold forming plate) or a sealing plate is joined to the passage forming substrate, or at the time of handling or attachment in the form of the passage forming substrate or the inkjet recording head, or similar situations.

In particular, to meet an increasing demand for arranging the nozzle orifices at a higher density, the interval of the nozzle orifices in the parallel direction of the pressure generating chambers is shortened, which in turn decreases the rigidity of the compartment walls on both sides of ink supply path and the communicating path in the parallel direction. In addition, the rigidity of the compartment walls is also decreased by a reduction in thickness of the passage forming substrate.

In the case where the width of the ink supply path is made smaller than that of the pressure generating chamber (in the parallel direction) as described in JP-A-2005-53080, although the thickness of the compartment walls defining the ink supply path becomes larger than in the case of Japanese Patent No. 3422364, there is a possibility that destruction due to an external pressure occurs because of the high-density arrangement of the pressure generating chambers (ink supply paths). For this reason, the above-described problem occurs due to the insufficient rigidity of the compartment walls defining the communicating paths regardless of the presence or absence of the ink supply paths.

Moreover, the above-described problems may occur not only in the inkjet recording head but also in a liquid-jet head that jets a liquid other than ink.

SUMMARY

An advantage of some aspects of the invention is to provide a liquid-jet head and a liquid-jet apparatus that can prevent destruction of a passage forming substrate, a piezoelectric actuator, a vibration plate, and the like.

A first aspect of the invention is a liquid-jet head including a passage member and reinforcement walls. The passage member includes a plurality of individual passages and a manifold communicating commonly with the individual passages. The individual passages each have a pressure generating chamber communicating with a nozzle orifice that ejects liquid. The pressure generating chambers are formed on one surface side of the passage member on an opposite side from the nozzle orifices. The individual passages and the manifold communicate with each other through communicating paths, and each adjacent two of the individual passages communicate with each other through the corresponding communicating path. The reinforcement walls are each provided between the communicating paths in a direction of which the individual passages arrange, and define the communicating paths.

According to the first aspect, the communicating paths each communicating with two of the individual passages are provided, making it possible to reduce the cross-sectional area of the communicating path, and to thus enhance the rigidity of the reinforcement walls.

Here, it is preferable that the pressure generating chambers and the communicating paths be provided to open on the one surface side of the passage member, openings of the pressure generating chambers and the communicating paths be sealed with a vibration plate, and a joint plate be fixed to the passage member on the vibration plate side. With this configuration, the joint plate serves as a kind of reinforcement plate for the passage member, making it possible to enhance the rigidity of the passage member and the vibration plate, and to thus suppress destruction of the passage member and the vibration plate.

Alternatively, it is also possible that the pressure generating chambers and the communicating paths be provided to open on the one surface side of the passage member, openings of the pressure generating chambers and the communicating paths be sealed with a vibration plate, and a joint plate be fixed to the passage member on an opposite side from the vibration plate.

Moreover, it is preferable that the vibration plate seal the manifold, and at least a part of a piezoelectric actuator that generates pressure change in a liquid in each of the pressure generating chambers be extended to a region of the vibration plate where the vibration plate seals the manifold. With this configuration, since at least a part of the piezoelectric actuator is extended, the rigidity of the vibration plate in a region facing the communicating path and the manifold can be enhanced.

A second aspect of the present invention is a liquid-jet apparatus including the liquid-jet head of the first aspect.

According to the second aspect, a liquid-jet apparatus having an improved reliability with destruction being suppressed can be achieved.

DESCRIPTION OF EXEMPLARY EMBODIMENTS

Detailed descriptions will be provided below for the invention on the basis of embodiments.

Embodiment 1

Figure 1:
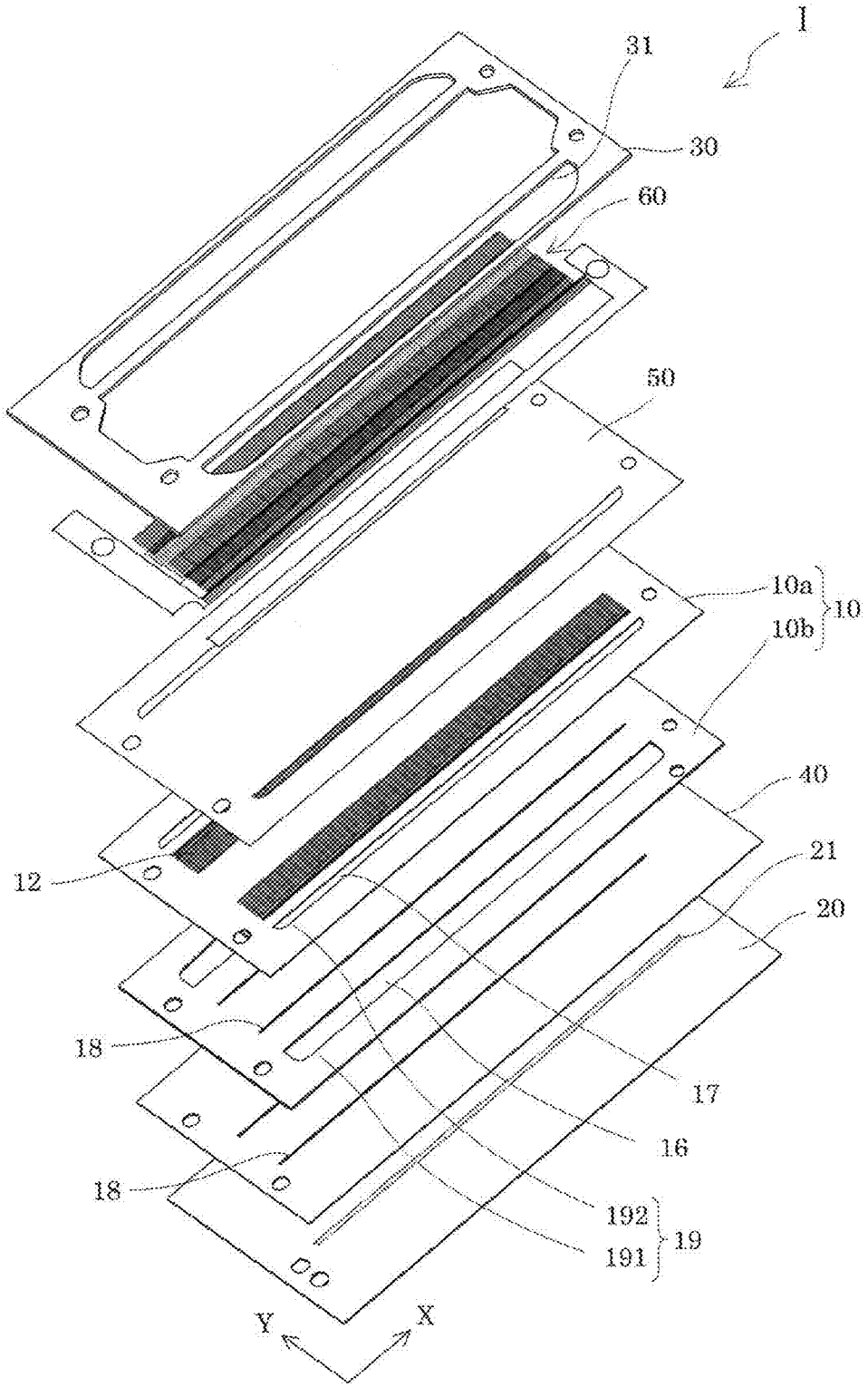
FIG. 1 is an exploded, perspective view of a recording head according to Embodiment 1.
Figure 2:
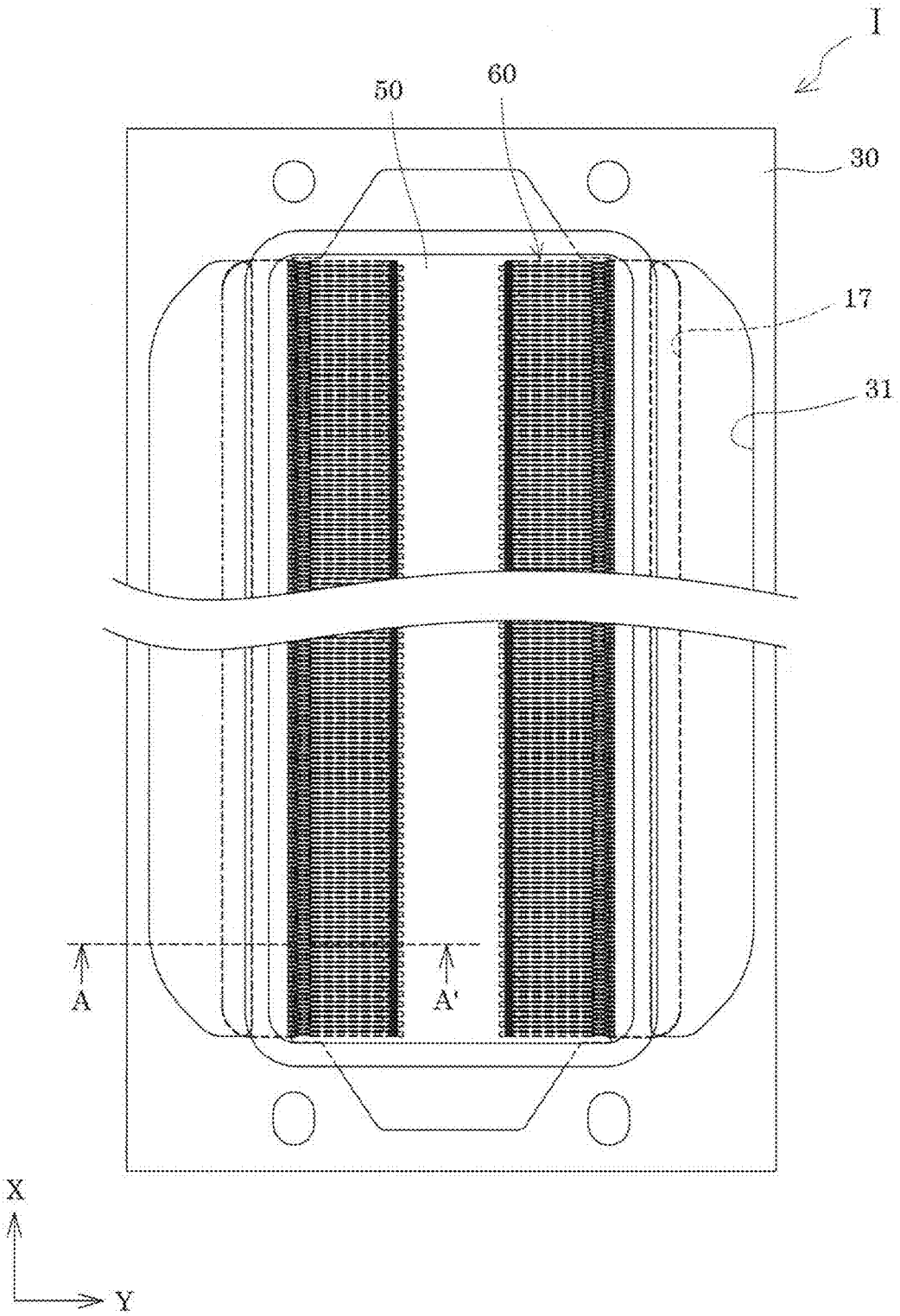
FIG. 2 is a plan view of the recording head according to Embodiment 1.
Figure 3:
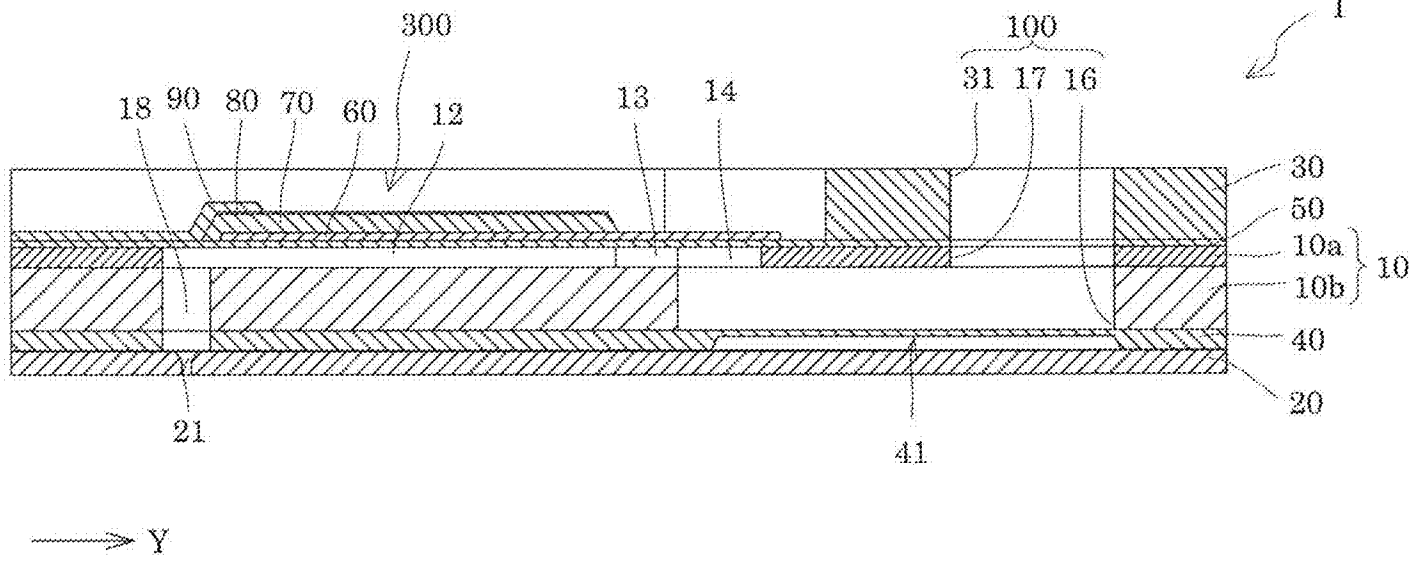
FIG. 3 is a cross-sectional view of the recording head according to Embodiment 1.

FIG. 1 is an exploded, perspective view of an inkjet recording head, showing an example of a liquid-jet head according to Embodiment 1 of the invention. FIG. 2 is a plan view of the inkjet recording head. FIG. 3 is a cross-sectional view taken along the line A-A' in FIG. 2.

As shown in the figures, a passage forming substrate 10, which is a passage member of Embodiment 1 constituting an inkjet recording head I, is formed by laminating a first passage forming substrate 10*a* and a second passage forming substrate 10*b* in Embodiment 1. Note that although the passage forming substrate 10 is shown as the first passage forming substrate 10*a* and the second passage forming substrate 10*b* in Embodiment 1, these substrates may be an integrally-formed single substrate. In addition, the passage member is not limited to that constituted of the passage forming substrate 10 but may be one formed by laminating the passage forming substrate 10 and another substrate.

The passage forming substrate 10 (the first passage forming substrate 10*a* and the second passage forming substrate 10*b*) may be formed from a ceramic plate of alumina ($Al_2O_3$), zirconia ($ZrO_2$), or the like, or a thin plate of a stainless steel (SUS) or the like.

In the passage forming substrate 10 (the first passage forming substrate 10*a*), pressure generating chambers 12 are provided in parallel in a direction in which a plurality of nozzle orifices 21 that eject ink of the same color are provided in parallel. Hereinafter, this direction is referred to as a parallel direction of the pressure generating chambers 12 or a first direction X. The passage forming substrate 10 (the first passage forming substrate 10*a*) is provided with a plurality of rows, two rows in Embodiment 1, in each of which the pressure generating chambers 12 are provided in parallel in the first direction X. Hereinafter, the direction in which the rows of the pressure generating chambers 12 in parallel are provided is referred to as a second direction Y. Note that in Embodiment 1, the pressure generating chambers 12 provided in parallel in the first direction X in each row are arranged to be alternately displaced slightly in the second direction Y. Note that the pressure generating chambers 12 are provided to open in one surface side of the passage forming substrate 10 (on the opposite surface side from the nozzle orifices 21 in Embodiment 1).

Moreover, ink supply paths 13 and communicating paths 14 are provided in the passage forming substrate 10 (the first passage forming substrate 10*a*) on one end side of the pressure generating chambers 12 in the second direction Y. Here, the ink supply paths 13 and the communicating paths 14 will be described in further detail with reference to FIGS. 4A and 4B. Note that FIG. 4A is a plan view of the passage forming substrate and FIG. 4B is a cross-sectional view taken along the line B-B' in FIG. 4A.

Figure 4A:
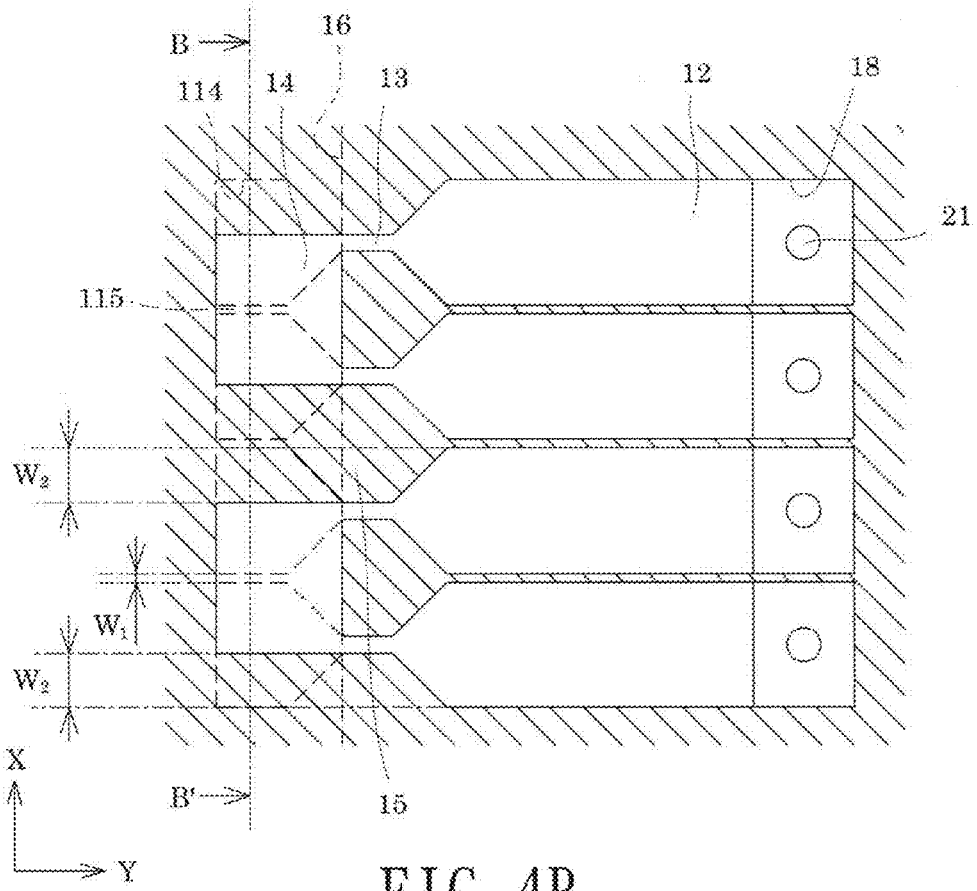
FIG. 4A is a plan view of a passage forming substrate according to Embodiment 1.
Figure 4B:
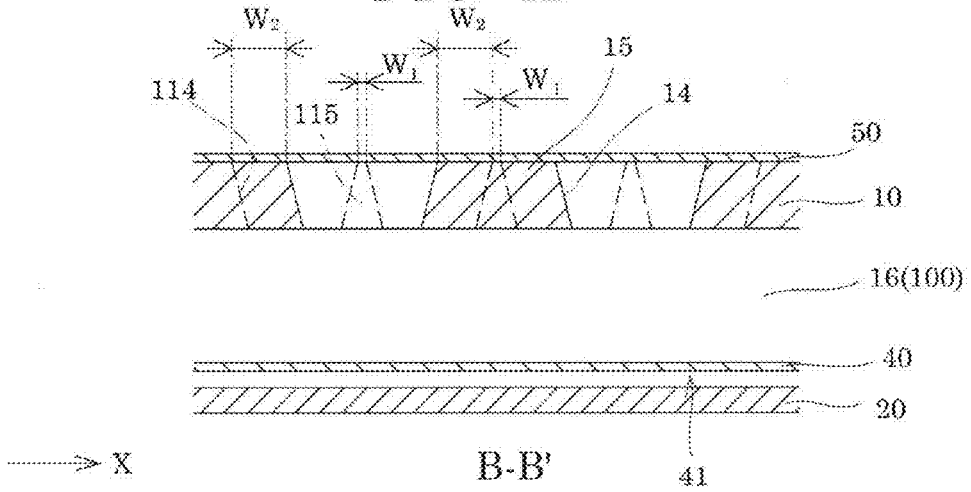
FIG. 4B is a cross-sectional view of the passage forming substrate according to Embodiment 1.

As shown in FIGS. 4A and 4B, the ink supply paths 13 are provided on one end side of the pressure generating chambers 12 in the second direction Y (on the opposite side from the ends thereof communicating with the nozzle orifices 21) to open on one surface side of the passage forming substrate 10 (on the opposite surface side from the nozzle orifices 21). In addition, each of the ink supply paths 13 is provided to have a width smaller than that of each of the pressure generating chambers 12 in the first direction X, thereby generating a certain passage resistance. Note that although in Embodiment 1, the width of each ink supply path 13 in the first direction X is reduced from both sides, the invention is not limited particularly to this, and the width may be reduced only from one side. Alternatively, each ink supply path 13 may be formed by reducing the depth (in the lamination direction of the passage forming substrate 10 and a nozzle plate 20); however, this is not preferable because the rigidity of the compartment walls defining side surfaces of the ink supply path 13 in the first direction X is decreased. Moreover, a plurality of the ink supply paths 13 may be provided for each pressure generating chamber 12 such that the cross-sectional area of the opening of each ink supply path 13 is decreased.

The communicating paths 14 are provided on one end portions of the ink supply paths 13 in the second direction Y (on the opposite side from the pressure generating chambers 12) to open on one surface side of the passage forming substrate 10 (on the opposite surface side from the nozzle orifices 21).

In addition, each of the communicating paths 14 allows individual passages (each including the pressure generating chamber 12, the ink supply path 13, and the like) adjacent to each other in the first direction X to communicate with each other. The individual passages in Embodiment 1 each include the pressure generating chamber 12, the ink supply path 13, and a nozzle communicating hole 18, which will be described later. In other words, each communicating path 14 allows end portions of two of the individual passages (the ink supply paths 13 in Embodiment 1) to communicate with each other.

In addition, the communicating paths 14 allow a manifold 100 (a first manifold portion 16), which will be described later, and the individual passages (the ink supply paths 13 in Embodiment 1) to communicate with each other.

Side surfaces of each communicating path 14 in the first direction X are defined by reinforcement walls 15. In other words, the reinforcement wall 15 is provided between the communicating paths 14 adjacent to each other in the first direction X. In other words, each communicating path 14 allows the individual passages adjacent to each other to communicate with each other, forming a pair of the two individual passages, and the reinforcement wall 15 is disposed between the communicating paths 14 of the respective pairs.

In Embodiment 1, the reinforcement wall 15, which defines the inner side surfaces of the communicating paths 14 in the first direction X, extends between the ink supply paths 13 and defines one of inner side surfaces of each ink supply path 13 in the first direction X. In other words, the side surface of the reinforcement wall 15, which defines the communicating path 14, and the side surface of the ink supply path 13 in the first direction X are formed to be flush with each other.

Figure 5A:
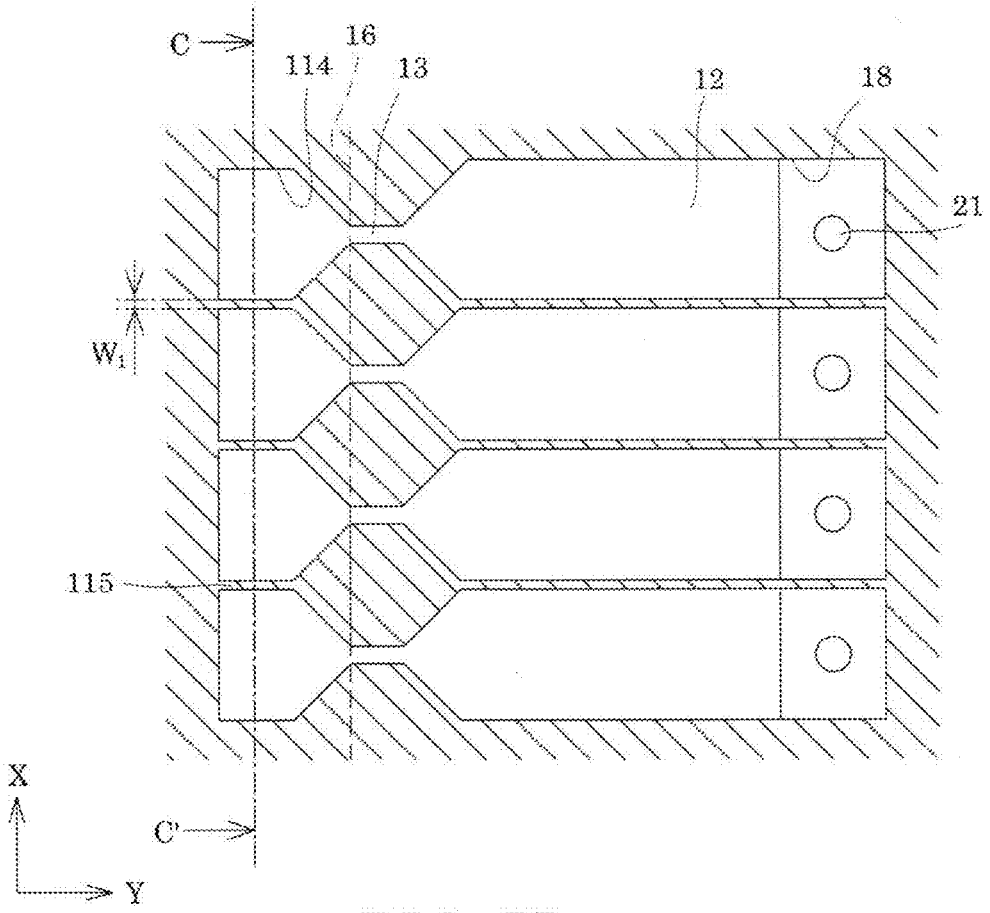
FIG. 5A is a plan view of a passage forming substrate of Comparative Example according to Embodiment 1.
Figure 5B:
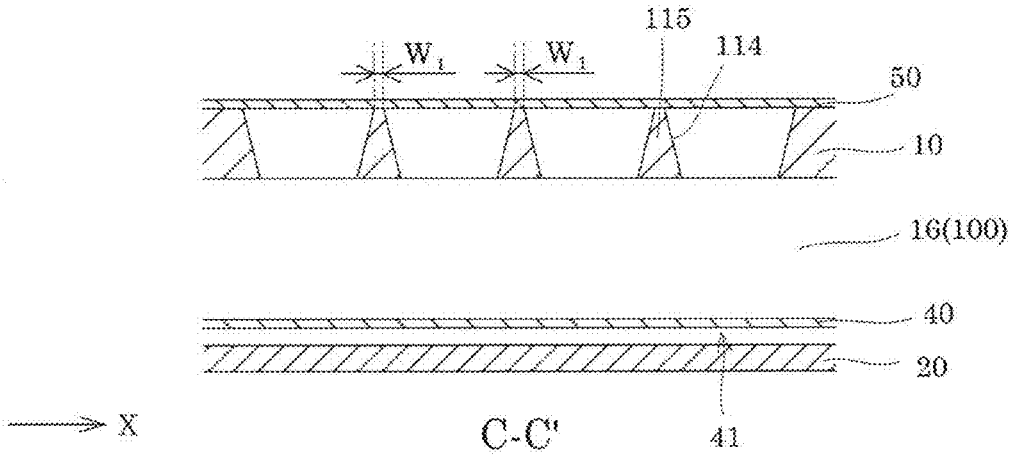
FIG. 5B is a cross-sectional view of the passage forming substrate of Comparative Example according to Embodiment 1.

Here, for comparison, an example in which a communicating path is provided individually for each of individual passages is shown in FIGS. 5A and 5B. Note that FIG. 5A is a plan view of a passage forming substrate and FIG. 5B is a cross-sectional view taken along the line C-C' in FIG. 5A, both showing Comparative Example of the communicating path.

As shown in FIGS. 5A and 5B, in the case where a communicating path 114 is provided individually for each of individual passages, a relatively large opening area is required as the communicating path 114 in order to reduce the passage resistance. As a result, the width $W_1$ of a compartment wall 115 between the communicating paths 114 adjacent to each other in the first direction X is reduced.

By contrast, as shown in FIGS. 4A and 4B, in the case where the communicating path 14 is provided in communication with two of the individual passages, a relatively large opening area is ensured as the communicating path 14. For this reason, it is possible to increase the width of the reinforcement wall 15 in the first direction X by reducing the width of the communicating path 14 in the first direction X. Note that in FIGS. 4A and 4B, the compartment walls 115 of FIGS. 5A and 5B are indicated by dotted lines.

Here, as shown in FIGS. 4A and 4B, although the number of the reinforcement walls 15 is approximately half the number of the compartment walls 115 shown in FIGS. 5A and 5B, the width of each single reinforcement wall 15 in the first direction X is larger by width $W_2 \times 2$ than the width of each single compartment wall 115. Note that the width $W_2$ is the width on one side by which the width of the reinforcement wall 15 is made larger than that of the compartment walls 115 in the first direction X. Specifically, when one of the reinforcement walls 15 in FIGS. 4A and 4B is compared to its corresponding two compartment walls 115 in FIGS. 5A and 5B, the width of the reinforcement wall 15 in the first direction X is increased by the width $W_2 \times 2$ but decreased by the width $W_1$ of the single compartment wall 115, as compare to that of the two compartment walls 115. In other words, the width of the reinforcement wall 15 is expressed by $W_1+(2\times W_2)$ while the total width of the two compartment walls 115 is expressed by $(2\times W_1)$. Accordingly, if the width $W_2 \times 2$, by which the reinforcement wall 15 is made wider than the compartment wall 115, is larger than the width $W_1$, by which the reinforcement wall 15 is made narrower, i.e., if $(W_2 \times 2) > W_1$, the rigidity of the reinforcement wall 15 is larger than that of its corresponding two compartment walls 115. In addition, the width $W_1$ of each compartment wall 115 has been decreased in these days for the purpose of increasing the density of the nozzle orifices 21 and decreasing the size of the inkjet recording head I. Therefore, in the case of the inkjet recording head I with a general structure having the compartment walls 115, defining the communicating paths 14, each communicating with the two individual passages, by use of the reinforcement walls 15 meets the condition $(W_2 \times 2) > W_1$.

Providing the reinforcement walls 15 as the compartment walls defining the communicating paths 14 as described above makes it possible to enhance the rigidity of the reinforcement walls 15. For this reason, it is possible to suppress deformation of the reinforcement walls 15 when an external pressure is applied to the passage forming substrate 10, and to thereby suppress destruction of piezoelectric actuators 300 and a vibration plate 50, which would occur due to the deformation of the reinforcement walls 15. In other words, in the case of the compartment walls 115 as shown in FIGS. 5A and 5B, because of the lower rigidity of the compartment walls 115, the application of an external pressure to the passage forming substrate 10 may lead to destruction of the compartment walls 115, and also causes the piezoelectric actuators 300 and the vibration plate 50 to largely deform, resulting in occurrence of destruction such as cracking. In Embodiment 1, the rigidity of the reinforcement walls 15 can be enhanced, making it possible to suppress deformation of the reinforcement walls 15 when an external pressure is applied to the passage forming substrate 10, thereby suppressing destruction of the reinforcement walls 15, and also to suppress deformation of the piezoelectric actuators 300 and the vibration plate 50, thereby suppressing destruction of the piezoelectric actuators 300 and the vibration plate 50. Note that examples of the external pressure applied to the passage forming substrate 10 include those applied due to a wide variety of causes, such as a pressure applied when another member such as a joint plate (a manifold plate 30) or a compliance plate 40, which will be described later, is joined to the passage forming substrate 10, a pressure applied when the passage forming substrate 10 is handled, a pressure applied when the passage forming substrate 10 is cut out for manufacture from a single large-sized substrate, and a pressure applied when the inkjet recording head I is transported or attached to another member, for example. It should be noted that a pressure is applied particularly to the vibration plate 50 when the manifold plate 30, which is the joint plate, is joined to the vibration plate 50 side of the passage forming substrate 10. At this point, the reinforcement walls 15 effectively act during the joining of the joint plate, suppressing destruction of the reinforcement walls 15 and the vibration plate 50.

In addition, the passage forming substrate 10 is provided with first manifold portions 16 and second manifold portions 17 which communicate with the pressure generating chambers 12 through the ink supply paths 13 and the communicating paths 14.

The first manifold portion 16 is provided to penetrate the second passage forming substrate 10*b* in the thickness direction (the lamination direction of the first passage forming substrate 10*a* and the second passage forming substrate 10*b*), and communicates with the communicating path 14.

In addition, the second manifold portion 17 is provided to penetrate the first passage forming substrate 10*a* in the thickness direction and to communicate with the first manifold portion 16. In Embodiment 1, the second manifold portion 17 and the communicating path 14 are defined by a wall portion provided therebetween. Accordingly, the second manifold portion 17 does not communicate with the communicating path 14 directly, but communicates with the communicating path 14 through the first manifold portion 16.

These first manifold portion 16 and second manifold portion 17 are provided continuously in the first direction X across the plurality of pressure generating chambers 12 provided in parallel in the first direction X, and constitute a part of the manifold 100 communicating commonly with the plurality of pressure generating chambers 12.

Moreover, nozzle communicating holes 18 are provided in the pressure generating chambers 12 of the passage forming substrate 10 on the opposite side from the ink supply paths 13 in the second direction Y. The nozzle communicating holes 18 penetrate the passage forming substrate 10 (the second passage forming substrate 10*b*) in the thickness direction. The nozzle communicating holes 18 allow the pressure generating chambers 12 and nozzle orifices 21, which will be described later, to communicate with each other.

In this manner, the passage forming substrate 10 of Embodiment 1 is provided with the individual passages each including the pressure generating chamber 12, the ink supply path 13, and the nozzle communicating hole 18.

The compliance plate 40 is provided on a surface of the passage forming substrate 10 on the side where the first manifold portions 16 are formed. The compliance plate 40 seals the bottom faces of the first manifold portions 16 provided in the passage forming substrate 10. In addition, in the compliance plate 40, regions facing the first manifold portions 16 are formed with a smaller thickness than the other regions to serve as compliance portions 41 that are deformed by pressure change in a liquid inside the manifold 100.

Note that the compliance plate 40 may be formed by using a metal material such as stainless steel (SUS), for example. Alternatively, the compliance plate 40 may be formed by using a composite material obtained by laminating a flexible film, for example, a polyphenylene sulfide (PPS) film, and a plate-shaped member of a hard material such as a metal, for example, stainless steel (SUS) or the like. When the composite material is used for the compliance plate 40, the compliance portions 41 may be formed with only the flexible film.

In addition, a nozzle plate 20 provided with the nozzle orifices 21 is joined to the compliance plate 40 on the opposite surface side from the passage forming substrate 10. The nozzle plate 20 is made of a plate-shaped member formed from a metal material such as stainless steel (SUS) or a ceramic material such as silicon. The nozzle orifices 21 are formed in the nozzle plate 20 at the same pitch as the pressure generating chambers 12. Specifically, four rows in each of which the nozzle orifices 21 are provided in parallel in the first direction X are provided in parallel in the second direction Y. In other words, two rows in each of which the nozzle orifices 21 are provided in parallel in the first direction X are provided in parallel in the second direction Y for each row in which the pressure generating chambers 12 are provided in parallel in the first direction X. The two rows in each of which the nozzle orifices 21 are provided in parallel in the second direction Y are arranged at positions displaced from each other by half of the pitch of the nozzle orifices 21 in the first direction X. The nozzle orifices 21 and the corresponding pressure generating chambers 12 communicate with each other through the nozzle communicating holes 18 provided in the passage forming substrate 10 and the compliance plate 40.

In addition, the vibration plate 50 and the piezoelectric actuators 300 are provided on the passage forming substrate 10 on the opposite side from the nozzle plate 20.

The vibration plate 50 is made of an inorganic film of a ceramic such as zirconia ($ZrO_2$), alumina ($Al_2O_3$), or the like, silicon oxide, or the like, or a thin plate of stainless steel (SUS) or the like. One surface of the pressure generating chambers 12, the ink supply paths 13, and the communicating paths 14 is sealed with the vibration plate 50.

Then, the piezoelectric actuators 300 are provided on the vibration plate 50 in regions facing the respective pressure generating chambers 12.

The piezoelectric actuators 300 include a first electrode 60 provided on the vibration plate 50, piezoelectric layers 70 provided independently for the respective pressure generating chambers 12, and second electrodes 80 provided on the respective piezoelectric layers 70. Such a piezoelectric layer 70 is formed by attaching or printing a green sheet made of a piezoelectric material, for example. The first electrode 60 is a common electrode which is provided across the piezoelectric layers 70 provided in parallel and which is used commonly for the piezoelectric actuators 300. The first electrode 60 functions as a part of the vibration plate. On the other hand, the second electrodes 80 are provided for the respective piezoelectric layers 70 and function as individual electrodes for the respective piezoelectric actuators 300. It is of course possible to provide the first electrodes 60 as individual electrodes for the respective piezoelectric layers 70 and to provide the second electrode 80 as a common electrode used commonly for the plurality of piezoelectric layers 70.

In addition, in Embodiment 1, lead electrodes 90 made of, for example, gold (Au) or the like are provided for the respective second electrodes 80, which are individual electrodes for the respective piezoelectric actuators 300. The lead electrodes 90 are led out from the nozzle communicating holes 18 side and extended onto the vibration plate 50.

The manifold plate 30, which is the joint plate, is joined onto the surface of the passage forming substrate 10 (including the surface of the vibration plate 50) with the piezoelectric actuators 300 formed thereon. Third manifold portions 31 are provided in the manifold plate 30. The third manifold portions 31 communicate with the second manifold portions 17 of the passage forming substrate 10 to constitute a part of the manifold 100. In other words, the manifold 100 in Embodiment 1 includes the first manifold portions 16 and the second manifold portions 17, which are provided in the passage forming substrate 10, as well as the third manifold portions 31, which is provided in the manifold plate 30.

The passage forming substrate 10 constituting the inkjet recording head I is formed as follows by using two of the first passage forming substrate 10*a* and the second passage forming substrate 10*b*, each formed by shaping a clay-like ceramic material, a so-called green sheet, into a predetermined thickness. Specifically, the pressure generating chambers 12 and the like are drilled in the first passage forming substrate 10*a* while the first manifold portions 16, the nozzle communicating holes 18, and the like are drilled in the second passage forming substrate 10*b*. Thereafter, the first passage forming substrate 10*a*, the second passage forming substrate 10*b*, and the vibration plate 50 are laminated and baked to thus be integrated with no need of any adhesive agent. Note that the vibration plate 50 may be joined after the passage forming substrate 10 is baked, depending on the material of the vibration plate 50. After that, the piezoelectric actuators 300 and the like are formed on the vibration plate 50. Then, the manifold plate 30, which is the joint plate, is joined to the passage forming substrate 10 on the piezoelectric actuators 300 side while the compliance plate 40 and the nozzle plate 20 are joined to the surface of the passage forming substrate 10 on the opposite side from the piezoelectric actuators 300. As a result, the inkjet recoding head I is manufactured.

In the inkjet recording head I having the above-described configuration, ink is first taken into the manifold 100 from an unillustrated ink cartridge (a storage unit) to fill the passages from the manifold 100 to the nozzle orifices 21 with the ink. Thereafter, in accordance with a recording signal from an unillustrated drive circuit, voltage is applied to each of the piezoelectric actuators 300 corresponding to the respective pressure generating chambers 12 to thereby flexurally deform the vibration plate 50 together with the piezoelectric actuator 300. As a result, the pressure inside the pressure generating chamber 12 is increased to eject an ink droplet from the nozzle orifice 21.

As described above, in Embodiment 1, the communicating path 14 communicating with two of the individual passages is provided, and the communicating path 14 is defined by the reinforcement walls 15. This enhances the rigidity of the reinforcement walls 15, making it possible to suppress destruction of the reinforcement walls 15 when an external force is applied to the passage forming substrate 10, and making also it possible to suppress destruction of the vibration plate 50 and the piezoelectric actuators 300.

Embodiment 2

Figure 6:
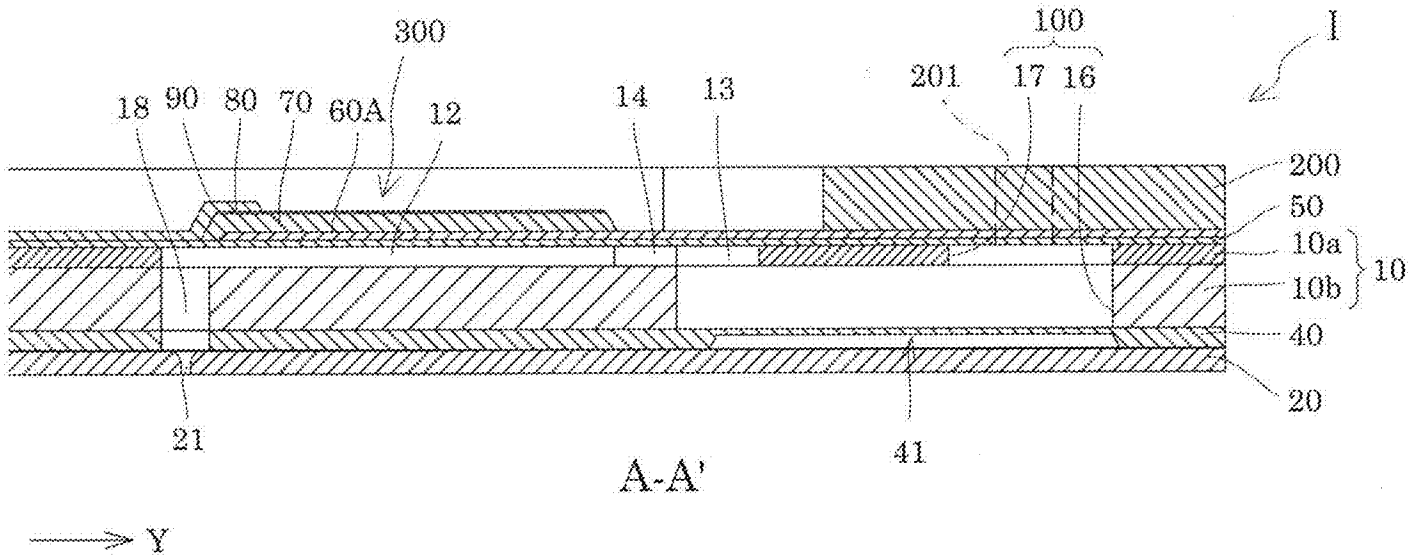
FIG. 6 is a cross-sectional view of a recording head according to Embodiment 2.

FIG. 6 is a cross-sectional view of an inkjet recording head, which is an example of a liquid-jet head according to Embodiment 2 of the invention. Note that the same components as those of Embodiment 1 described above are denoted by the same reference numerals, and redundant description will be omitted.

As shown in FIG. 6, an inkjet recording head I of Embodiment 2 includes a passage forming substrate 10, a nozzle plate 20, a compliance plate 40, and an ink introduction plate 200, which is the joint plate.

First manifold portions 16 and second manifold portions 17 are formed in the passage forming substrate 10. The ink introduction plate 200 is joined to the passage forming substrate 10 on the piezoelectric actuators 300 side.

An ink introducing port 201 is provided in the ink introduction plate 200 in a region facing the second manifold portion 17. The ink introducing port 201 penetrates the ink introduction plate 200 in the thickness direction. For this reason, in Embodiment 2, the vibration plate 50 extends to above the opening of the second manifold portion 17 on the piezoelectric actuator 300 side, so that the second manifold portion 17 is defined by the vibration plate 50. Accordingly, a manifold 100 of Embodiment 2 includes a first manifold portion 16 and the second manifold portion 17.

Moreover, the piezoelectric actuator 300 includes a first electrode 60A, a piezoelectric layer 70, and a second electrode 80. The first electrode 60A extends from a region facing the pressure generating chamber 12 to a region facing the second manifold portion 17 through on the ink supply path 13 and the communicating path 14 (the reinforcement wall 15).

In the inkjet recording head I having the above-described structure, providing the communicating path 14 communicating two of the individual passages in the same manner as Embodiment 1 described above makes it possible to enhance the rigidity of the reinforcement walls 15 defining the communicating paths 14. In addition, the first electrode 60A is provided on the communicating path 14 and on the reinforcement wall 15 and is extended to on the second manifold portion 17. with this structure, the upper side of the communicating path 14, the reinforcement wall 15, and the second manifold portion 17 is constituted of the vibration plate 50 and the first electrode 60A, making it possible to enhance the rigidity, as compared to the case of being constituted of only the vibration plate 50 as in Embodiment 1. Accordingly, it is possible to further suppress destruction of the reinforcement walls 15 and the vibration plate 50 when an external force is applied to the passage forming substrate 10. In particular, when the ink introduction plate 200, which is the joint plate, is joined to the passage forming substrate 10, the reinforcement walls 15 effectively act to suppress destruction of the reinforcement walls 15 and the vibration plate 50.

Note that although in Embodiment 2, the ink introduction plate 200 is provided in place of the manifold plate 30 of Embodiment 1 described above, the invention is not limited to this configuration. For example, when the manifold plate 30 is provided as well, the first electrode 60A may be extended to the vicinity of the third manifold portion 31, making it possible to enhance the rigidity of the vicinity of the third manifold portion 31.

In addition, although in Embodiment 2, only the first electrode 60A is extended to the region facing the second manifold portion 17, the invention is not limited to this configuration. Any member such as members constituting the piezoelectric actuators 300, the lead electrode 90, and the like may be provided. In other words, in Embodiment 2, providing a member constituting the piezoelectric actuators 300 or the like on another region makes it possible to reduce the costs of the materials and the costs due to an increase in the number of processes, as compared to the case where another material is provided in another process.

Other Embodiments

The embodiments of the invention have been described so far, the essential configuration of the invention is not limited to those described above. For example, in the above-described embodiments, the inkjet recording head in which the communicating paths are provided at the same depth as that of the pressure generating chambers has been described, the invention is not limited to those in terms of the shape of the manifold, the depth of the communicating holes, and the like. Here, another example of the inkjet recording head will be described with reference to FIG. 7. Note that FIG. 7 is a cross-sectional view of an inkjet recording head according to another embodiment of the invention.

Figure 7:
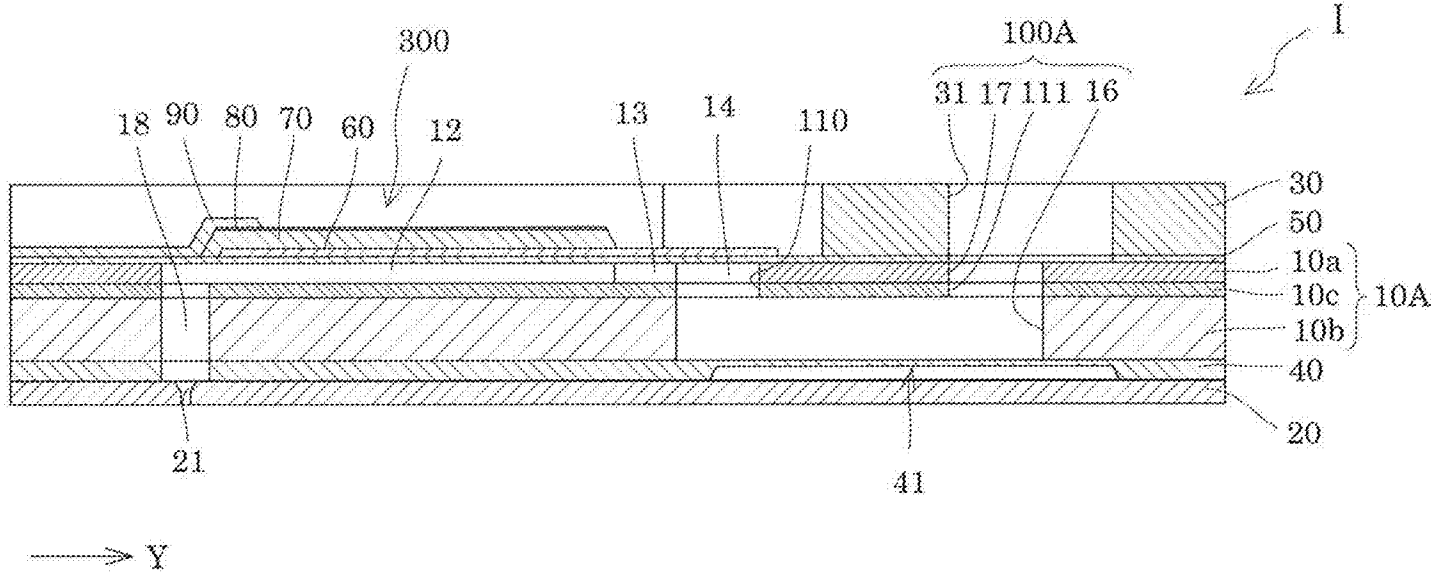
FIG. 7 is a cross-sectional view of a recording head according to another embodiment.

As shown in FIG. 7, an inkjet recording head I includes a passage forming substrate 10A, which is a passage member, a nozzle plate 20, a manifold plate 30, a vibration plate 50, and piezoelectric actuators 300.

The passage forming substrate 10A includes a first passage forming substrate 10*a*, a second passage forming substrate 10*b*, and a third passage forming substrate 10*c*. The first passage forming substrate 10*a* is provided on the piezoelectric actuators 300 side. Pressure generating chambers 12, ink supply paths 13, and communicating paths 14 are formed in the first passage forming substrate 10*a*.

In addition, the second passage forming substrate 10*b* is provided on the nozzle plate 20 side. First manifold portions 16, nozzle communicating holes 18, and the like are formed in the second passage forming substrate 10*b*. Moreover, the third passage forming substrate 10*c* is arranged between the first passage forming substrate 10*a* and the second passage forming substrate 10*b*. Connecting paths 110 and fourth manifold portions 111 are provided in the third passage forming substrate 10*c*. The connecting path 110 allows the first manifold portion 16 and the communicating path 14 to communicate with each other, and the fourth manifold portion 111 allows the first manifold portion 16 and the second manifold portion 17 to communicate with each other.

The connecting path 110 may constitute a part of the individual passage, like the communicating path 14, or may be formed continuously along the first direction X to constitute a part of a manifold 100A. In the embodiment, the connecting path 110 is provided for each two individual passages (two pressure generating chambers 12), like the communicating path 14.

In addition, the fourth manifold portion 111 is provided with an opening similar to that of the second manifold portion 17 in the embodiment.

Moreover, in the inkjet recording head I shown in FIG. 7, the manifold 100A is constituted of the first manifold portion 16, the second manifold portion 17, the third manifold portion 31, and the fourth manifold portion 111.

The passage forming substrate 10A described above may be formed by using three substrates, i.e., the first passage forming substrate 10*a*, the second passage forming substrate 10*b*, and the third passage forming substrate 10*c*, each formed by shaping a clay-like ceramic material, i.e., a so-called green sheet, into a predetermined thickness. Specifically, the pressure generating chamber 12, the second manifold portion 17, and the like are drilled in the first passage forming substrate 10*a*. The first manifold portion 16, the nozzle communicating hole 18, and the like are drilled in the second passage forming substrate 10*b*. The connecting path 110, the fourth manifold portion 111, and the like are drilled in the third passage forming substrate 10*c*. Thereafter, the first passage forming substrate 10*a*, the second passage forming substrate 10*b*, the third passage forming substrate 10*c*, and the vibration plate 50 are laminated and baked to thus be integrated with no need of any adhesive agent. In other words, although in FIG. 7, the first passage forming substrate 10*a*, the second passage forming substrate 10*b*, and the third passage forming substrate 10*c*, which constitute the passage forming substrate 10A, are shown as separate members, these substrates are actually baked simultaneously together to form a single integrated substrate. Of course, if the first passage forming substrate 10*a*, the second passage forming substrate 10*b*, and the third passage forming substrate 10*c* are laminated after being baked independently, the passage forming substrate 10A including three layers laminated together as shown in FIG. 7 is obtained.

With this configuration, the height of the reinforcement walls 15 in the lamination direction is increased, and the rigidity of the reinforcement walls 15 can be further enhanced, making it possible to suppress destruction of the reinforcement walls 15, the vibration plate 50, and the piezoelectric actuators 300, which would occur due to stress generated when the manifold plate 30, which is the joint plate, is joined.

In addition, although in the above-described example, the joint plate (the manifold plate 30) is provided on the vibration plate 50 side of the passage forming substrate 10, the invention is not limited to this configuration, and the joint plate may be provided on the opposite side of the passage forming substrate 10 from the vibration plate 50.

Figure 8:
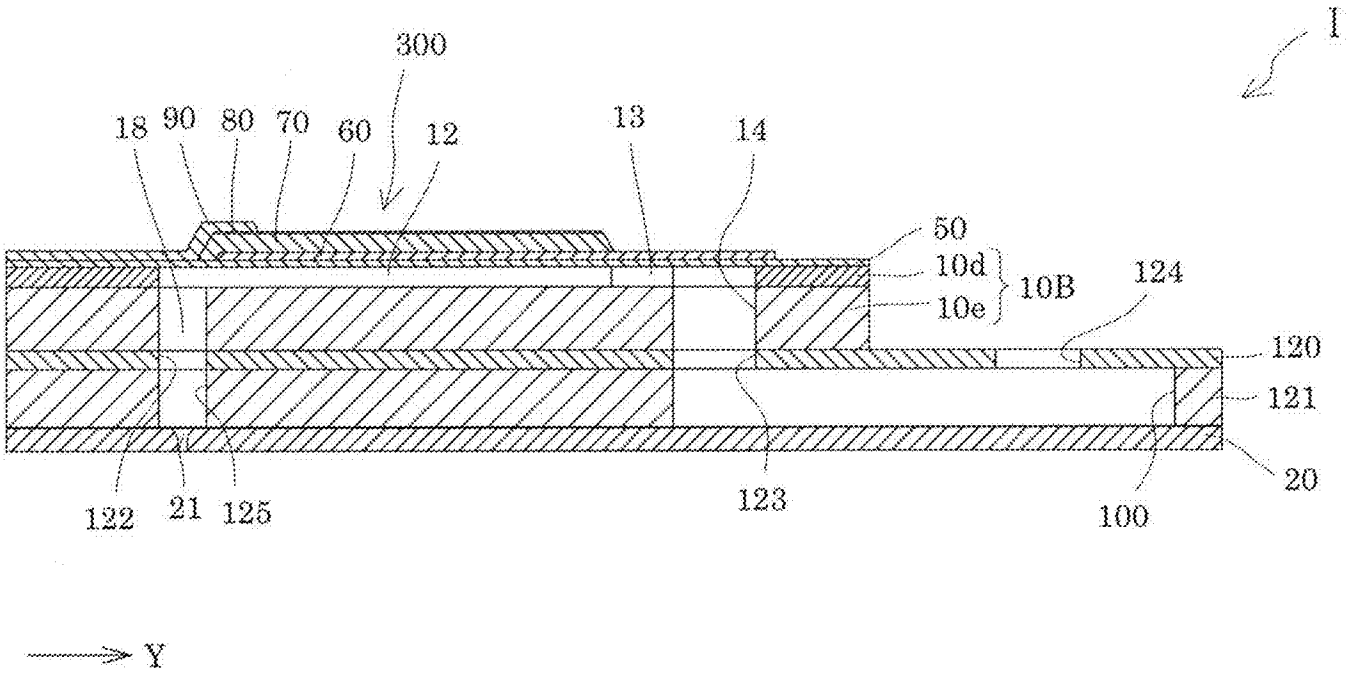
FIG. 8 is a cross-sectional view of a recording head according to still another embodiment.

This example is shown in FIG. 8. Note that FIG. 8 is a cross-sectional view of an inkjet recording head according to still another embodiment of the invention.

As shown in FIG. 8, a passage member includes a passage forming substrate 10B, a liquid supply port forming plate 120, and a manifold forming plate 121. The manifold forming plate 121, which is the joint plate, is joined to the passage forming substrate 10B on the opposite side from the vibration plate.

The passage forming substrate 10B includes a fourth passage forming substrate 10*d* and a fifth passage forming substrate 10*e*.

Pressure generating chambers 12 are provided in the passage forming substrate 10B in parallel in the first direction X. In addition, ink supply paths 13 and communicating paths 14 are provided in the passage forming substrate 10B on one end side of the pressure generating chambers 12 in the second direction Y.

The ink supply paths 13 are provided to penetrate the fourth passage forming substrate 10*d* in the thickness direction (the lamination direction). In addition, the communicating paths 14 are provided to penetrate the fourth passage forming substrate 10*d* and the fifth passage forming substrate 10*e* in the thickness direction. In the same manner as the embodiments described above, each of the communicating paths 14 allows the individual passages (including the pressure generating chambers 12, the ink supply paths 13, and the like) adjacent to each other to communicate with each other. Side surfaces of each of the communicating paths 14 in the first direction X are defined by reinforcement walls (not shown).

Piezoelectric actuators 300 are provided on one surface side of the passage forming substrate 10B with a vibration plate 50 interposed therebetween. In addition, the liquid supply port forming plate 120 and the manifold forming plate 121 in which a manifold 100 is formed are joined to the passage forming substrate 10B on the opposite surface side from the piezoelectric actuators 300. A nozzle plate 20 in which nozzle orifices 21 are formed is joined to the manifold forming plate 121 on the opposite side from the passage forming substrate 10B. In other words, the manifold 100 is formed in the passage member on the nozzle orifices 21 side.

Moreover, nozzle communicating holes 18 communicating with the pressure generating chambers 12 on the opposite side from the ink supply paths 13 are formed in the passage forming substrate 10B.

The liquid supply port forming plate 120 is made of a plate-shaped member formed from a metal material such as stainless steel (SUS), a ceramic material such as zirconia ($ZrO_2$) or alumina ($Al_2O_3$), or a silicon material. First nozzle connecting paths 122 and liquid supply ports 123 are formed in the liquid supply port forming plate 120. The first nozzle connecting paths 122 allow the nozzle orifices 21 and the pressure generating chambers 12 (the nozzle communicating holes 18) to communicate with each other, and the liquid supply ports 123 allow the manifold 100 and the communicating paths 14 to communicate with each other. Moreover, liquid introduction ports 124 are formed in the liquid supply port forming plate 120. The liquid introduction ports 12 communicate with the manifold 100 and supply the manifold 100 with ink from a liquid storage unit such as an external ink tank. In other words, the manifold 100 and the individual passage including the pressure generating chamber 12 and the like, of the embodiment, communicate with each other through the communicating path 14 and the liquid supply port 123. In other words, the communicating path 14, which allows the manifold 100 and the individual passage including the pressure generating chamber 12 to communicate with each other, encompasses those allowing the manifold 100 and the individual passage to communicate with each other directly and those allowing the manifold 100 and the individual passage to communicate with each other through another passage such as the liquid supply port 123.

Moreover, second nozzle connecting paths 125 are formed in the manifold forming plate 121. Each of the second nozzle connecting path 125 communicates with the first nozzle connecting path 122 and allows the pressure generating chamber 12 and the nozzle orifice 21 to communicate with each other.

The manifold forming plate 121 as described above is made of a plate-shaped member formed from a metal material such as stainless steel (SUS), a ceramic material such as zirconia ($ZrO_2$) or alumina ($Al_2O_3$), or a silicon material.

In such an example, the passage member including the pressure generating chambers 12 and the ink supply paths 13 is constituted of the passage forming substrate 10B, the liquid supply port forming plate 120 in which the liquid supply ports 123 are formed, and the manifold forming plate 121 in which the manifold 100 is formed. Although not shown, it is possible to use a part of the nozzle plate 20 or the liquid supply port forming plate 120, facing the manifold 100, as the compliance portion. In this case, there is no need to provide an independent compliance plate, making it possible to reduce the manufacturing costs of the liquid-jet head.

With such a configuration as well, the same effect as that of Embodiment 1 described above can be exerted by allowing two of the individual passages adjacent to each other in the first direction X to communicate with each other through the communicating path 14 and providing the reinforcement wall between the communicating paths 14 in the first direction X.

Further, in the above-described embodiments, the individual passage constituted of the pressure generating chamber 12, the ink supply path 13, and the nozzle communicating hole 18 is illustrated. However, the individual passage may not be provided with the ink supply path 13, and may be provided with a passage other than the above-described passages. In other words, it suffices that the individual passage is provided for each piezoelectric actuator 300 and the communicating path 14 allows two of the individual passages to communicate with each other.

Moreover, in Embodiment 1 described above, the inkjet recording head I including the piezoelectric actuators 300 is illustrated. However, the pressure generator that generates pressure change in the pressure generating chambers 12 is not limited to the piezoelectric actuators 300. The same effect can be exerted also with inkjet recording heads including: a thin-film piezoelectric actuator which has a piezoelectric material formed by a sol-gel method, a MOD method, a sputtering method, or the like; a vertical vibration piezoelectric element which has layers of a piezoelectric material and an electrode forming material alternately laminated and which expands and contracts in the axial direction; a so-called electrostatic actuator which has a vibration plate and an electrode arranged with a predetermined gap and which controls the vibration of the vibration plate by using electrostatic force; or a heat generating element which is disposed in a pressure generating chamber for ejecting ink droplets from a nozzle orifice by utilizing bubbles generated by the heat generation of the heat generating element.

Figure 9:
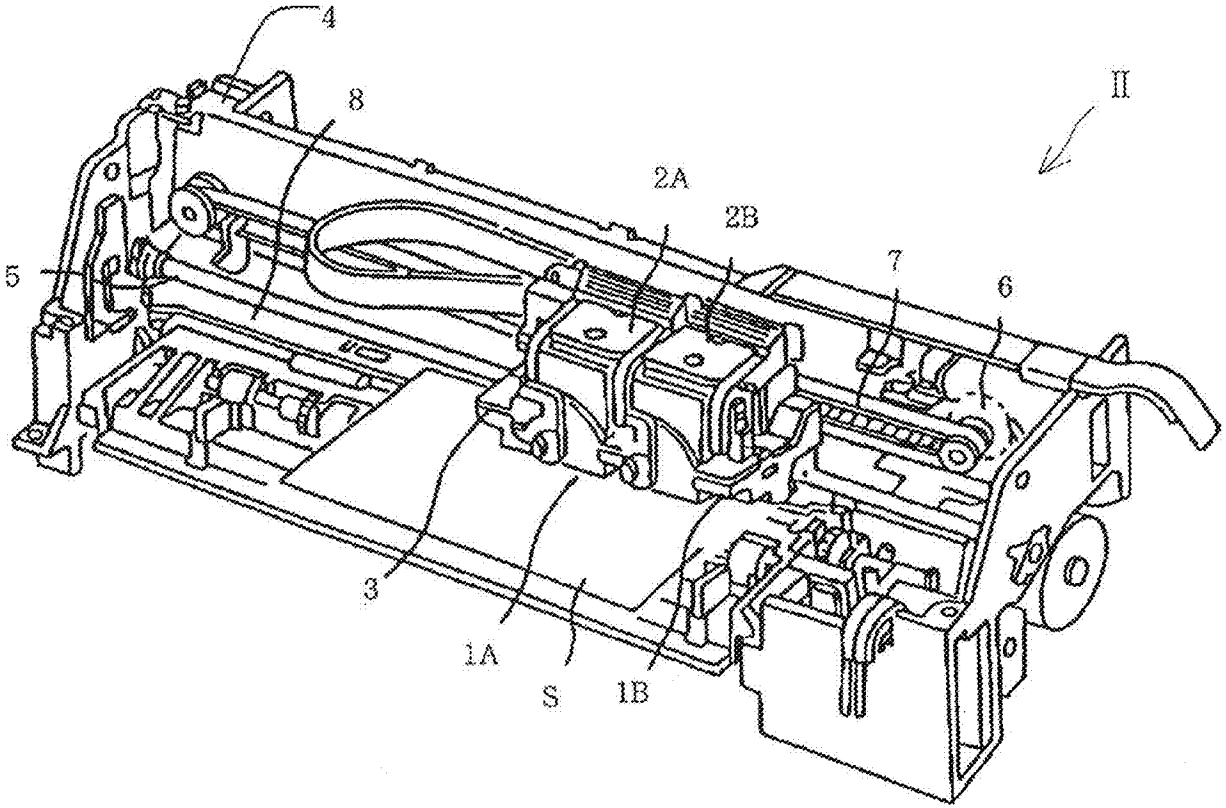
FIG. 9 is a schematic view of a recording apparatus according to one embodiment of the invention.

In addition, the inkjet recording head of each embodiment constitutes a part of an inkjet recording head unit including an ink passage communicating with an ink cartridge or the like, and is installed in an inkjet recording apparatus. FIG. 9 is a schematic view showing an example of the inkjet recording apparatus.

In an inkjet recording apparatus II shown in FIG. 9, inkjet recording head units 1A and 1B having a plurality of inkjet recording heads I (hereinafter called also as head units 1A and 1B) are provided detachably with cartridges 2A and 2B, which constitute ink supply units. The head units 1 are mounted on a carriage 3, and the carriage 3 is provided on a carriage shaft 5 attached to an apparatus main body 4 such that the carriage 3 is movable in an axial direction of the carriage shaft 5. The recording head units 1A and 1B eject a black ink composition and a color ink composition, respectively, for example.

Then, drive force of a drive motor 6 is transmitted to the carriage 3 through a plurality of unillustrated gears and a timing belt 7, thereby moving the carriage 3 with the head units 1A and 1B mounted thereon along the carriage shaft 5. On the other hand, in the apparatus main body 4, a platen 8 is provided along the carriage shaft 5. A recording sheet S, which is a recording medium such as paper, fed by an unillustrated feeder roller or the like, is wound up and transported by the platen 8.

Note that the above-described embodiments are described by giving the inkjet recording heads as examples of the liquid-jet head; however, the invention is directed widely to the general liquid-jet heads, and can of course be applied also to liquid-jet heads that eject liquids other than ink. Examples of the other liquid-jet heads includes various types of recording heads used in image recording apparatuses such as printers, color material-jet heads used for manufacture of color filters of liquid crystal displays and the like, electrode material-jet heads used for forming electrodes in organic EL displays, FEDs (Field Emission Displays), and the like, bioorganic material-jet heads used for manufacturing biochips.

The entire disclosure of Japanese Patent Application No. 2013-070483, filed Mar. 28, 2013 is incorporated by reference herein.

The invention claimed is:

1. A liquid-jet head comprising:

a passage member including a plurality of individual passages and a manifold communicating commonly with the individual passages, the individual passages each having a pressure generating chamber communicating with a nozzle orifice that ejects liquid, the pressure generating chambers being formed on one surface side of the passage member on an opposite side from the nozzle orifices, the individual passages and the manifold communicating with each other through communicating paths, the individual passages being in arranged in groups of two individual passages, such that each group of two individual passages has a corresponding communicating path wherein liquid communicates from the two individual passages into the corresponding communicating path without passing through the manifold; and reinforcement walls each provided between the corresponding communicating path and a communicating path adjacent the corresponding communicating path in a direction of which the individual passages arrange, wherein a width of each reinforcement wall is larger than a width of a wall disposed between the two pressure generating chambers in a direction in which the individual passages are arranged.

2. The liquid-jet head according to claim 1, wherein the pressure generating chambers and the communicating paths are provided to open on the one surface side of the passage member, openings of the pressure generating chambers and the communicating paths are sealed with a vibration plate, and a joint plate is fixed to the passage member on the vibration plate side.

3. The liquid-jet head according to claim 1, wherein the pressure generating chambers and the communicating paths are provided to open on the one surface side of the passage member, openings of the pressure generating chambers and the communicating paths are sealed with a vibration plate, and a joint plate is fixed to the passage member on an opposite side from the vibration plate.

4. The liquid-jet head according to claim 1, wherein the vibration plate seals the manifold, and at least a part of a piezoelectric actuator that generates pressure change in a liquid in each of the pressure generating chambers is extended to a region of the vibration plate where the vibration plate seals the manifold.

5. A liquid-jet apparatus comprising:

the liquid-jet head according to claim 1.

* * * * *